US011808078B2

(12) United States Patent
Schmidt

(10) Patent No.: US 11,808,078 B2
(45) Date of Patent: Nov. 7, 2023

(54) RETROFIT ADAPTOR FOR GLAZING STRUCTURES AND METHOD THEREFOR

(71) Applicant: VISIONWALL INTERNATIONAL, INC., New York, NY (US)

(72) Inventor: Roy Schmidt, Edmonton (CA)

(73) Assignee: VISIONWALL INTERNATIONAL, INC., New York, NY (US)

( * ) Notice: Subject to any disclaimer, the term of this patent is extended or adjusted under 35 U.S.C. 154(b) by 61 days.

(21) Appl. No.: 17/463,821

(22) Filed: Sep. 1, 2021

(65) Prior Publication Data

US 2022/0186547 A1 Jun. 16, 2022

Related U.S. Application Data

(60) Provisional application No. 63/073,198, filed on Sep. 1, 2020.

(51) Int. Cl.
*E06B 3/54* (2006.01)

(52) U.S. Cl.
CPC ..... *E06B 3/5418* (2013.01)

(58) Field of Classification Search
CPC ..... E06B 3/5418
USPC ..... 52/203
See application file for complete search history.

(56) References Cited

U.S. PATENT DOCUMENTS 4,089,143 A * 5/1978 La Pietra ..... E06B 3/28 52/208
5,481,839 A * 1/1996 Lang ..... E04B 2/967 52/489.1
6,141,923 A * 11/2000 Habicht ..... E06B 5/165 52/235
7,536,832 B2 * 5/2009 DeYoung ..... E04F 10/08 16/382
8,567,142 B2 * 10/2013 Swartz ..... E06B 3/5427 52/745.12
2009/0241466 A1 * 10/2009 Gussakovsky ..... E04B 2/88 52/745.16
2010/0293882 A1 * 11/2010 Labrecque ..... E04B 2/967 52/705
2015/0284951 A1 * 10/2015 Frederick ..... E04B 2/90 52/235

(Continued)

*Primary Examiner* — Basil S Katcheves
*Assistant Examiner* — James J Buckle, Jr.
(74) *Attorney, Agent, or Firm* — PRAXIS

(57) ABSTRACT

A retrofit adaptor is provided for retrofitting a glazing structure comprising an inner frame body and an outer frame body with windowpanes therebetween forming a glazed window. The retrofit adaptor comprises outer and inner connecting elements and a thermal break interposed therebetween and connected thereto. The outer connecting element for being connected to the outer frame body and defines an outer clearance hole therethrough. The inner connecting element for being connected to the inner frame body. The thermal break defines a cavity for receiving insulation therein. A mechanical fastener is insertable through the outer clearance hole of the outer connecting element when unconnected to the outer frame body and through the inner connecting element when mounted to the inner frame body, via the cavity, for being fastened to the inner frame body. The outer frame body is connectable to the outer connecting element for closing the outer clearance hole. The cavity is filled with the insulation thereby plugging the outer clearance hole.

18 Claims, 6 Drawing Sheets

(56) References Cited

U.S. PATENT DOCUMENTS

| | | | | |
|---|---|---|---|---|
| 2016/0222653 | A1* | 8/2016 | Niehaus | E04D 13/0305 |
| 2017/0058538 | A1* | 3/2017 | Zahner | E04B 2/88 |
| 2017/0298621 | A1* | 10/2017 | Frederick | E04B 2/967 |
| 2019/0085618 | A1* | 3/2019 | Al Kassas | E04B 2/90 |

* cited by examiner

RETROFIT ADAPTOR FOR GLAZING STRUCTURES AND METHOD THEREFOR

CROSS-REFERENCE TO RELATED APPLICATIONS

The present application claims priority on U.S. Provisional Patent Application Ser. No. 63/073,198 filed on Sep. 1, 2020 and incorporated herein by reference in its entirety.

TECHNICAL FIELD

The present disclosure generally relates to retrofitting a glazing structure. More particularly, but not exclusively, the present disclosure relates to a retrofit adaptor for a glazing structure and a method therefor

BACKGROUND

Glazing structures include glazing units, insulated glazing, store front window structures, curtainwalls, window walls and other like structures. Common types of glazing that are used in architectural applications include clear and tinted float glass, tempered glass, and laminated glass as well as a variety of coated glasses, all of which can be glazed singly or as double, or even triple, glazing units. Insulating glass more commonly known as double glazing (or double-pane, and increasingly triple and quadruple glazing/pane), consists of two or more glass windowpanes separated by a vacuum or gas-filled space to reduce heat transfer across a part of the building envelope. The basic components of glazing structures are the windowpanes and the framing system which provides window pockets for receiving the glazing (or panes). The framing system defines outer parts exposed to the elements and inner parts, which are sealed from the outer elements. It is sometimes required to increase the glazing pocket depths in existing glazing structures or to cover the exposed surfaces of existing interior framing in order to increase the overall thermal performance of glazing structures. In many cases, when retrofitting preexisting frame systems the inner parts thereof are exposed to the aforementioned outer elements.

OBJECTS

An object of the present disclosure is to provide a retrofit adaptor device for retrofitting a glazing structure.

An object of the present disclosure is to provide a retrofit adaptor kit for retrofitting a glazing structure.

An object of the present disclosure is to a provide a retrofitted glazing structure.

An object of the present disclosure is to a provide a method for retrofitting a glazing structure.

SUMMARY

In accordance with an aspect of the present disclosure, there is provided a retrofit adaptor device for retrofitting a glazing structure comprising an inner frame body and an outer frame body with windowpanes therebetween forming a glazed window, the retrofit adaptor device comprising: an outer connecting element for being connected to the outer frame body and defining an outer clearance hole therethrough; an inner connecting element for being connected to the inner frame body; and a thermal break interposed between and connected to the outer and inner connecting elements, the thermal break defining a cavity for receiving insulation therein; wherein a mechanical fastener is insertable through the outer clearance hole of the outer connecting element when unconnected to the outer frame body and through the inner connecting element when mounted to the inner frame body, via the cavity, for being fastened to the inner frame body, the outer frame body being connectable to the outer connecting element for closing the outer clearance hole, wherein when the cavity is filled with the insulation the outer clearance hole is plugged thereby.

In accordance with an aspect of the present disclosure, there is provided a retrofit adaptor device for retrofitting a glazing structure comprising an inner frame body and an outer frame body with windowpanes therebetween forming a glazed window, the retrofit adaptor device comprising: a replacement outer frame body for replacing the outer frame body of the glazing structure; an outer connecting element for being connected to the replacement outer frame body and defining an outer clearance hole therethrough; an inner connecting element for being connected to the inner frame body; and a thermal break interposed between and connected to the outer and inner connecting elements, the thermal break defining a cavity for being filled with insulation; wherein a mechanical fastener is insertable through the outer clearance hole of the outer connecting element when unconnected to the replacement outer frame body and through the inner connecting element when mounted to the inner frame body, via the cavity, for being fastened to the inner frame body, the replacement outer frame body being connectable to the outer connecting element for closing the outer clearance hole, wherein when the cavity is filled with the insulation the outer clearance hole is plugged thereby.

In accordance with an aspect of the present disclosure, there is provided a retrofit adaptor kit for retrofitting a glazing structure comprising an inner frame body and an outer frame body with windowpanes therebetween forming a glazed window, the retrofit adaptor kit comprising: at least one replacement outer frame body for replacing the outer frame body of the glazing structure; at least one outer connecting element for being connected to the at least one replacement outer frame body and defining at least one outer clearance hole therethrough; at least one inner connecting element for being connected to the inner frame body; and at least one thermal break for being connectedly interposed between to the outer and inner connecting elements, the thermal break defining a cavity for being filled with insulation; at least one mechanical for being insertable though the at least one outer clearance hole of the at least one outer connecting element when unconnected to the at least one outer frame body and through the at least one inner connecting element when mounted to the inner frame body, via the cavity, for being fastened to the inner frame body, wherein the at least one replacement outer frame body is connectable to the at least one outer connecting element tor for closing the at least one outer clearance hole, wherein when the cavity is filled with the insulation the at least one outer clearance hole is plugged thereby.

In accordance with an aspect of the present disclosure, there is provided a retrofitted glazing structure comprising: a framing system comprising a pre-existing inner frame body and an outer frame body; a glazed window mounted to the framing system comprising windowpanes positioned between the inner and outer frame bodies; a retrofit adaptor mounted to the framing system and comprising: an outer connecting element connected to the outer frame body and defining an outer clearance hole therethrough, the outer frame body closing the outer clearance hole; an inner connecting element connected to the inner frame body; a thermal break interposed between and connected to the outer and inner connecting elements, the thermal break defining a cavity for receiving insulation therein, the insulation providing for plugging the outer clearance; and a mechanical fastener inserted through the outer clearance hole and through the inner connecting, via the cavity, for fastening the retrofit adaptor device to the inner frame body.

In an embodiment, the inner connecting element defines an inner clearance hole for the mechanical fastener, wherein when the cavity is filled with the insulation, the inner clearance is plugged thereby.

In an embodiment, the inner connecting element is bondable to the inner frame body via a bonding agent.

In an embodiment, the inner connecting element comprises protrusions for being received by complementary grooves formed within the outer frame body.

In an embodiment, an auxiliary connecting element is mounted to the outer frame body for being mechanically fastened to the outer connecting element. In an embodiment, the inner connecting element is bondable to the auxiliary connecting element via a bonding agent.

In accordance with an aspect of the present disclosure, there is provided a method for retrofitting a glazing structure comprising a framing system and a glazed window comprising windowpanes, the method comprising: providing a thermal break defining opposite longitudinal ends thereof providing a predetermined length between the opposite longitudinal ends for a plurality of the windowpanes, the thermal break defining a cavity for receiving insulation therein; mounting an inner connecting element to one of the opposite longitudinal ends of the thermal break, the inner connecting element being configured for being mounted to a pre-existing inner frame body of the framing system; mounting an outer connecting element to another one of the opposite longitudinal ends of the thermal break, the outer connecting element being configured for being mounted to an outer frame body of the framing system, the outer connecting element defining an outer clearance hole therethrough leading to the cavity; fastening a mechanical fastener though the outer clearance hole and the cavity to the inner connecting element and the inner frame body; filling the cavity with insulation; plugging the outer clearance hole with insulation; mounting the outer frame body to the outer connecting element and closing the outer clearance hole thereby; and positioning the plurality of windowpanes between the outer and inner frame bodies along the length of the thermal break to define a retrofitted glazing window.

In an embodiment, the outer frame body is a replacement body for a pre-existing outer frame body.

In an embodiment, the outer frame body is a pre-existing frame body.

In an embodiment, the inner frame body defines an inner clearance hole for receiving the mechanical fastener therethrough. In an embodiment, the inner clearance hole is plugged with insulation.

In an embodiment, the method further comprises bonding the inner connecting element to the inner frame body with a bonding agent.

In an embodiment, the inner connecting element comprises protrusions for being received by corresponding grooves formed in the inner frame body.

In an embodiment, the outer frame body is bonded to the outer connecting element via a bonding agent.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated and in accordance with an aspect of the present disclosure, there is provided a retrofit adaptor for retrofitting a glazing structure comprising an inner frame body and an outer frame body with windowpanes therebetween forming a glazed window. The retrofit adaptor comprises an outer connecting element, an inner connecting element, and a thermal break therebetween. The outer connecting element is configured for being connected to the outer frame body and defines an outer clearance hole therethrough. The inner connecting element is configured for being connected to the inner frame body. The thermal break is connected to the outer and inner connecting elements and defines a cavity for receiving insulation therein. A mechanical fastener is insertable through the outer clearance hole of the outer connecting element when unconnected to the outer frame body and through the inner connecting element when mounted to the inner frame body, via the cavity, for being fastened to the inner frame body. The outer frame body is connectable to the outer connecting element for closing the outer clearance hole. The cavity is filled with the insulation thereby plugging the outer clearance hole. The outer frame body may be a pre-existing frame body or a replacement outer frame body forming part of the adaptor. The inner and outer connecting elements may be respectively bonded to the inner and outer frame bodies via a bonding agent.

Figure 1:
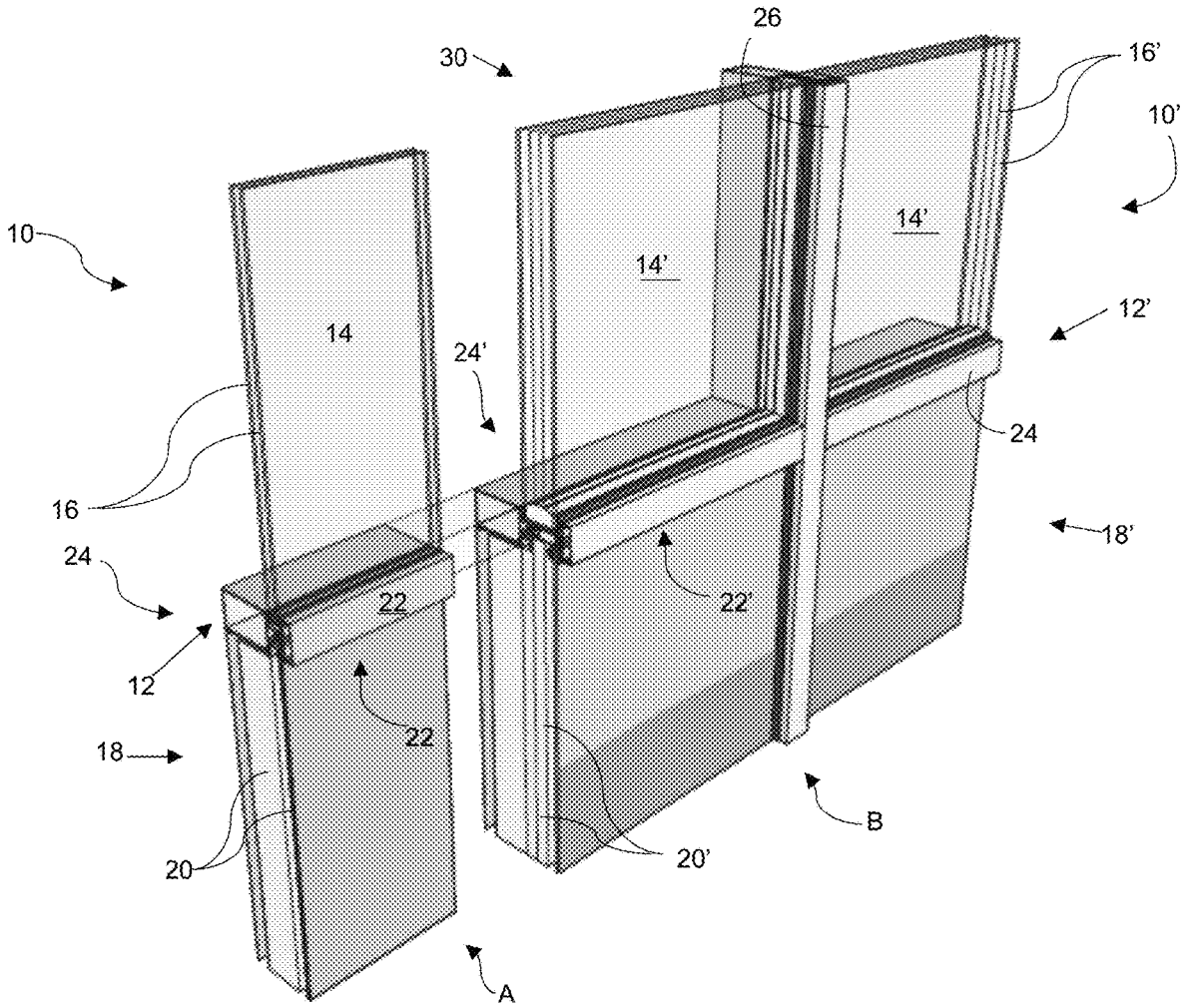
FIG. 1 shows a perspective view of a pre-existing glazing structure on the left hand-side portion thereof and, on the right-hand side portion thereof a similar glazing structure, following retrofitting with a retrofit adaptor in accordance with a non-restrictive illustrative embodiment of the present disclosure.

The left-hand side portion of FIG. 1, indicated by A, shows a portion of a pre-existing glazing structure 10 including a framing system 12, a glazed window 14 comprising windowpanes 16, wall sections 18 comprising panels 20. The framing system 12 includes external and internal portions, 22 and 24 respectively.

The right-hand side portion of FIG. 1, indicated by B, the pre-existing structure 10 has been retrofitted via the retrofit adaptor 11 and denoted herein as glazing structure 10'. Glazing structure 10' includes a retrofitted framing system 12' including external and internal portions, 22' and 24' respectively as well as vertical and horizontal runner sections, 26 and 28 respectively forming glazing pockets 30 therebetween for receiving a respective retrofitted glazed window 14'. Glazed window 14' is shown including a greater number of windowpanes 16 than the original glazed window 14. The retrofitted framing structure 12' also allows for a greater number of panels 20.

Figure 2:
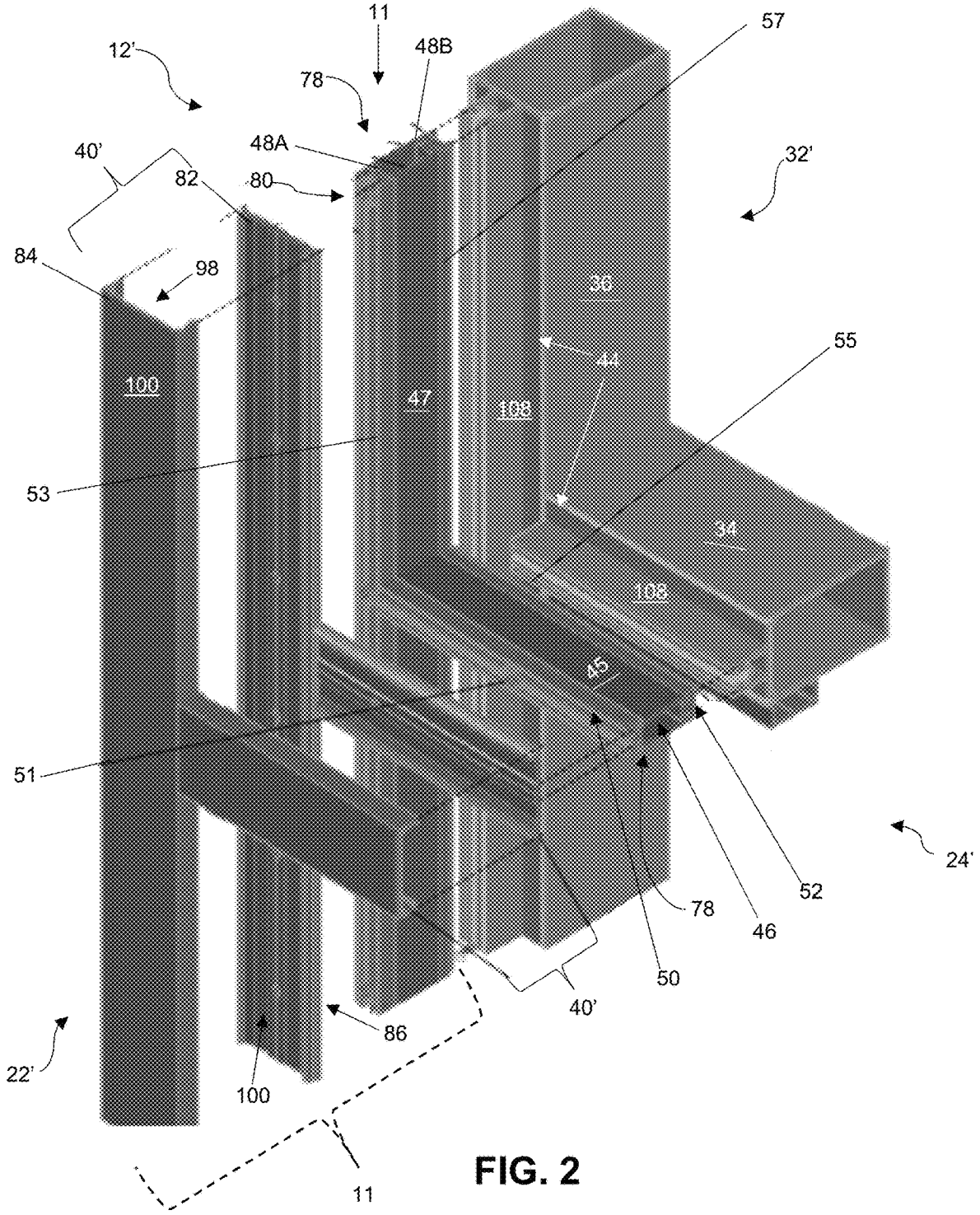
FIG. 2 is a perspective partially exploded view of the frame system of a glazing structure including the retrofit adaptor.

Turning now to FIG. 2, there is shown an exploded version of the retrofitted framing system 12' including the retrofit adaptor 11.

The framing system 12' comprises a pre-existing frame inner body 32 at the internal portion 22' thereof. The pre-existing frame body 32 comprises horizontal and vertical runners 34 and 36, respectively and a connector 38 extending therefrom. The framing system 12' also comprises a pre-existing outer frame body 40 at the external portion 24' thereof. In an embodiment, the frame outer body 40 does not belong to the pre-existing framing system 12' and as such the pre-existing frame outer body, for example, outer body 42 (of non-retrofitted framing system 12) shown in FIG. 1A is replaced by the frame outer body 40 belonging to the retrofit adaptor 11. The frame outer body 40 is complementarily configured to the frame inner body 32 and such defines horizontal and vertical runners 33 and 35 (see FIG. 5), which respectively align with horizontal and vertical runners 34 and 36 and which define a connecting side 44 for connecting the retrofit adaptor 11.

Figure 3:
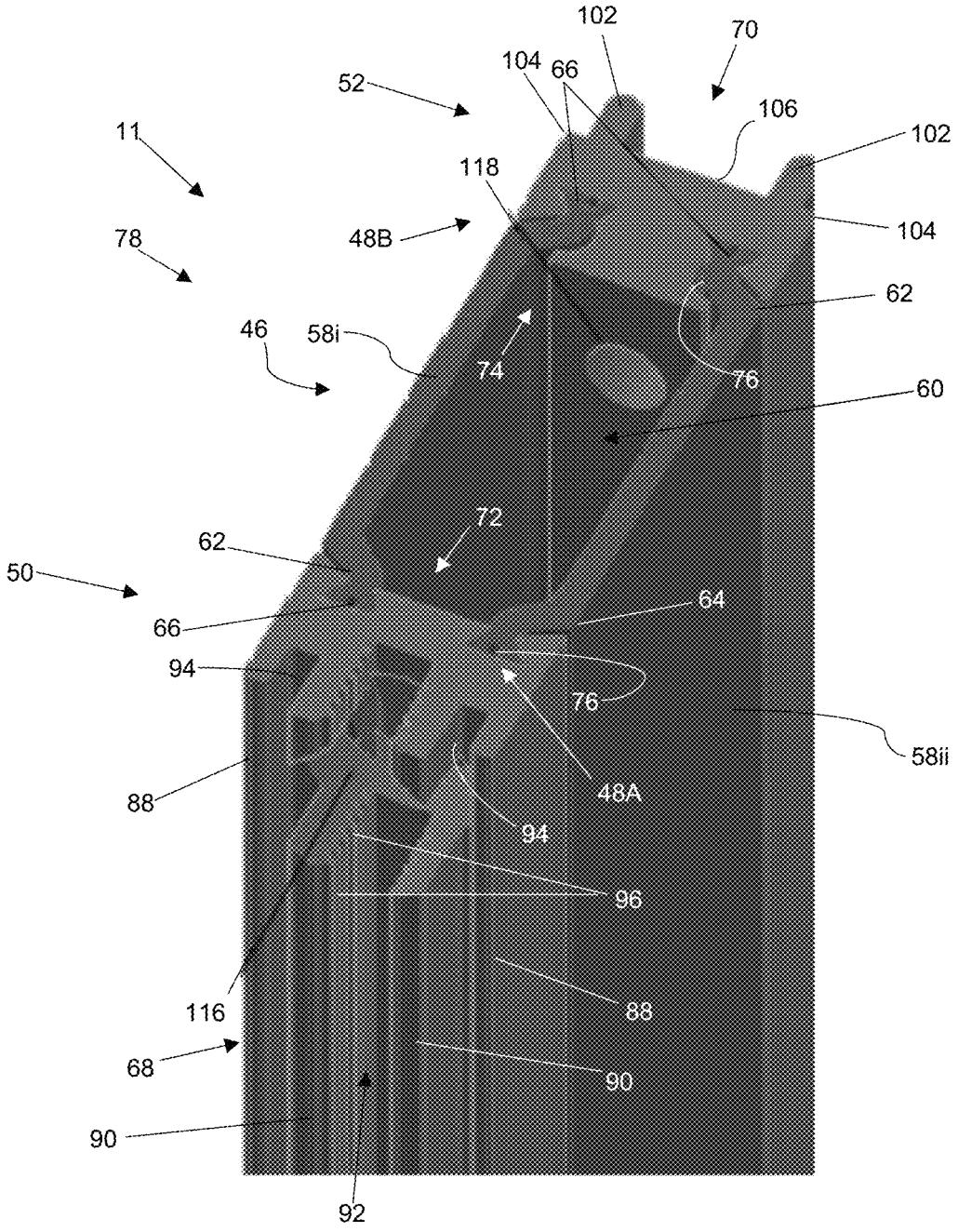
FIG. 3 is a top, perspective, enlarged portion view of the retrofit adaptor of FIG. 2.

With reference to FIGS. 2 and 3, retrofit adaptor 11 includes a thermal break member 46 having opposite ends 48A and 48B for respectively receiving exterior (or outer) and interior (or inner) connectors (or connecting elements), 50 and 52. The break member 46, and the exterior and interior connecting elements 50 and 52 is complementarily configured to align with the horizontal and vertical runners 34 and 36. Accordingly, break member 46 includes horizontal and vertical runners 45 and 47, connecting element 50 includes horizontal and vertical runners 51 and 53, connecting element 52 includes horizontal and vertical runners 55 and 57.

Turning to FIG. 3, the thermal break member 46 is an elongated hollow body defining opposite ends 48A and 48B. More particularly, the body 46 is made of a pair of opposite and spaced apart lateral panels 58*i* and 58*ii* defining a cavity or space 60 therebetween. The panels 58*i* and 58*ii* are assembled via their attachment to the exterior and interior connecting elements, 50 and 52 and ends 48A and 48B respectively. Indeed, each end 48A and 48B comprises a pair of inwardly and diagonally directed end portions 62 extending from each panel 58*i* and 58*ii* at respective corners 64. Each end portion 62 having at their free ends thereof respective linearly protruding and widening fins 66.

The exterior and interior connecting elements, 50 and 52 comprise respective outer and inner frame connecting ends 68 and 70 and respective opposite thermal break connecting ends 72 and 74. The thermal break member 46 is interposed between connecting elements 50 and 52 and connected thereto at ends 48A and 48B. Each connecting end 72 and 74, includes respective widening grooves 76 for receiving therein a complementarily configured widening fin 66.

Thus, when assembled and connected the connecting elements 50, 52 and the interposed thermal break 46 form a main structure 78 of the adaptor 11. Thus, adaptor main structure 78 includes an outer frame connecting end 68 for being connected to the frame outer body 40 and an inner connecting end 70 for being connected to the frame inner body 32.

Figure 4:
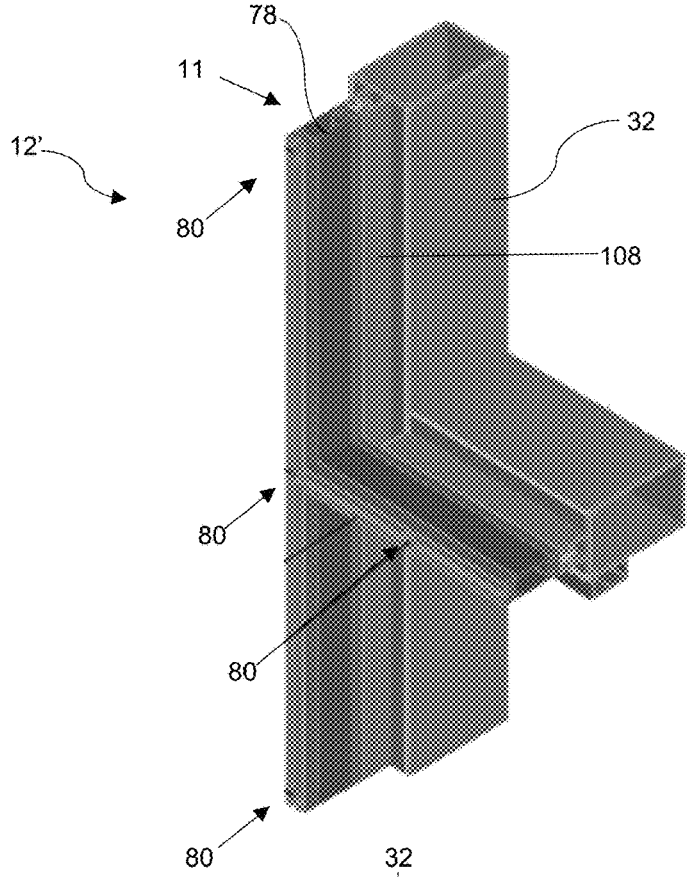
FIG. 4 is a perspective partially assembled view of the frame system of FIG. 2.

The main structure 78 includes frame fastening sections 80 as shown in FIGS. 2, 3 and 4 and as will be further described herein hereinbelow with reference to FIGS. 6 and 7.

In an embodiment, the outer frame body 40 comprises a pressure plate 82 and an external cap 84. The outer connecting end 68 of the exterior connecting element 50 is configured for mating with a correspondingly configured inner face 86 of the pressure plate 82. In an embodiment, the outer connecting end defines horizontal and vertical broken nose adaptors. Particularly, in this non-limiting example, the outer connecting end 68 includes shorter lateral protrusions 88 spaced apart from and flanking central longer protrusions 90 which form a central groove 92 therebetween. Grooves 94 are defined between a shorter lateral protrusion 88 and a longer central protrusion 90. The central protrusions 90 include ridges 96 at their inner faces circumscribing the groove 92.

In an embodiment, the inner face 86 of the pressure plate 82 comprises a groove and protrusion profile that corresponds with the groove and protrusion profile of the connecting end 68 for mutual mating, interference, or snap fit. Another embodiment of the inner face 86 of the pressure plate 82 is illustrated in FIG. 6.

In an embodiment, the inner face 98 of the external cap 84 and the outer face 100 of the pressure plate are complementarily configured for mutual mating, interference, or snap fit. Another embodiment of the inner face 98 of the external cap 84 and the outer face 100 of the pressure plate are illustrated in FIGS. 6 and 7.

The inner connecting end 70 of the interior connecting member 52 defines a pair of lateral protrusion 102 slightly inwardly positioned from the lateral sides 104 thereof and defining a wide slot 106 therebetween. The connecting side 44 of the inner frame body 32 forming a central protrusion body 108 for mating with the connecting end 70 of the adaptor 11 as will be further discussed below with reference to FIGS. 6 and 7.

Figure 5:
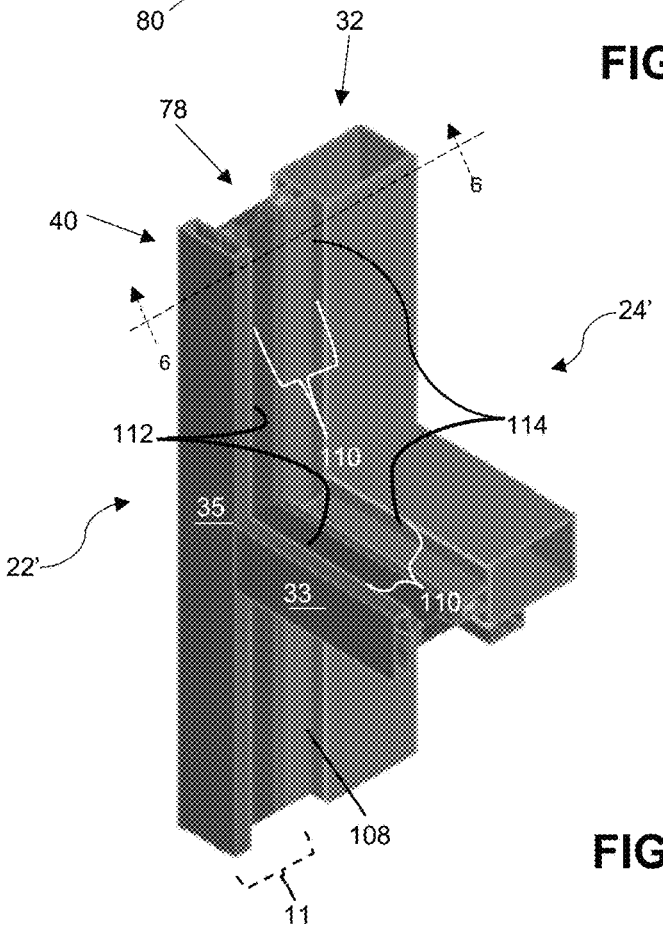
FIG. 5 is a perspective partially assembled view of the frame system of FIG. 2.

FIG. 4 shows the main adaptor structure 78 mounted to the pre-existing inner frame body 32 and FIG. 5 shows the outer frame body 40 mounted to the main adaptor structure 78 and thus completing the assembly of the retrofitted framing system 12'.

As shown in FIG. 5, the retrofit framing system 12' forms a mounting space 110 between the inner and outer frame bodies 40 and 32 along the width provided by the adaptor main structure 78 and the extension and the central protrusion body 108 of the inner frame body 32. The mounting space 110 is delimited by the inner abutment edges 112 formed along the inner face 86 of the pressure plate 82 and the inner abutment edge 114 formed along the connecting side 106 of the inner frame body 32. Windowpanes 16 and panels 20 are positionable within the mounting space 110.

With particular reference to FIG. 3 and general reference to FIGS. 2, 4, 6 and 7, a frame fastening section 80 of the main adaptor structure 78 includes an outer clearance hole 116 through the outer connector element 50 and extending from the outer frame body connecting end 68 thereof to the thermal break connecting end 72 thereof and being aligned with an inner clearance hole 118 formed in the thermal break connecting end 74 of the connecting element 52. Holes 116 and 118 are thus in fluid communication with the thermal space 60 defined by the lateral panels 58*i* and 58*ii*.

Figure 6:
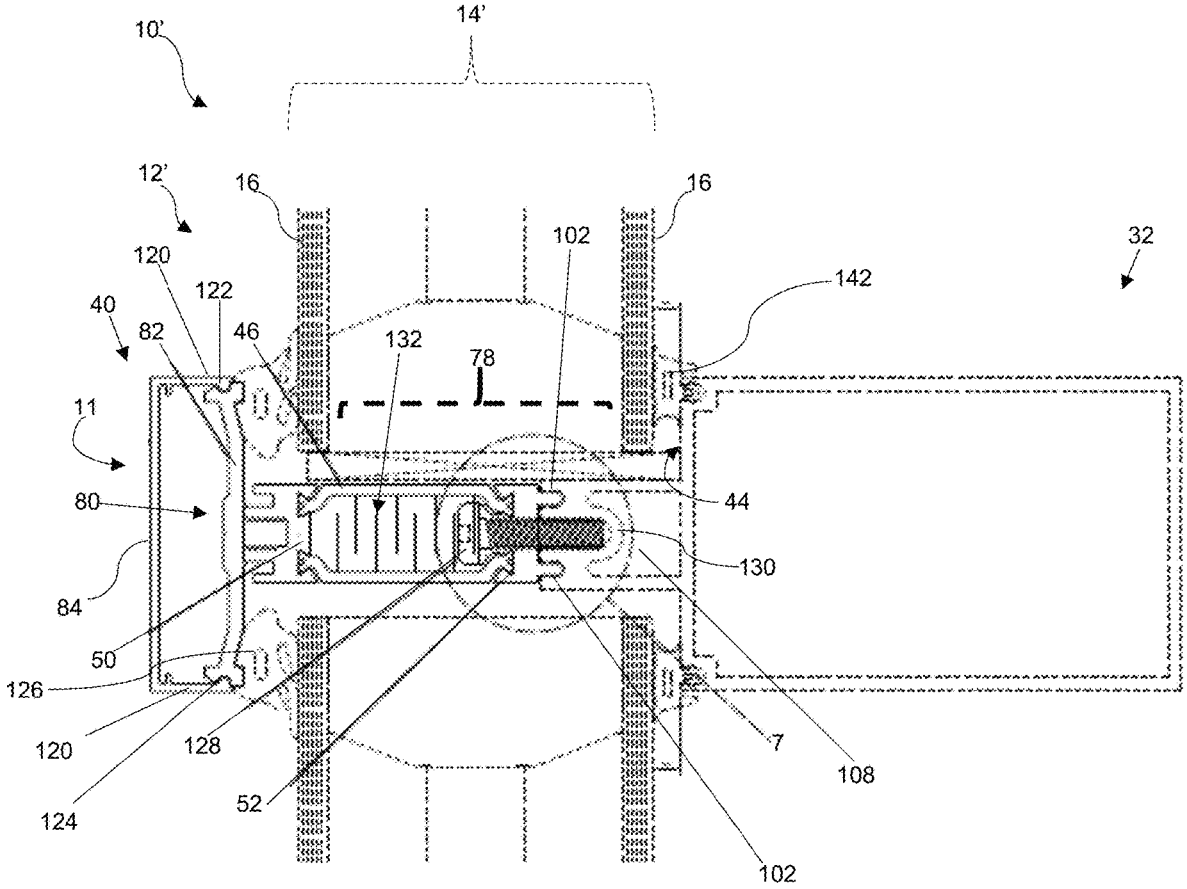
FIG. 6 is a cross-sectional view of the assembled frame system of FIG. 2, taken along line 6-6.

Turning to FIG. 6, the retrofitted glazing structure 10' is shown including the assembled retrofitted frame 12' is shown. The outer frame body 40 is shown including the cap 84 mounted to pressure plate 82. Particularly, the sides 120 include snap ridges 122 are fitted into notches 124 formed within the pressure plate 82. Sealing elements 126 are positioned between the windowpanes 16 and the pressure plate 82. A mechanical fastener 128, such as a screw for example, is inserted into the outer hole 116 (shown in FIG. 3) directly into the open area 60 (shown in FIG. 3) and from there into outer hole 118 to be fastened through the connector element 52 out of the side 70 thereof towards the connector side 44 of the outer frame 32. The central protrusion body 108 of the outer frame 32 includes a concave free end 130 for receiving the mechanical fastener 128 therein thus fastening the adaptor 11 to the inner frame body 32. The space 60 is filled with insulation material 132 following fastening plugging hole 116.

Figure 7:
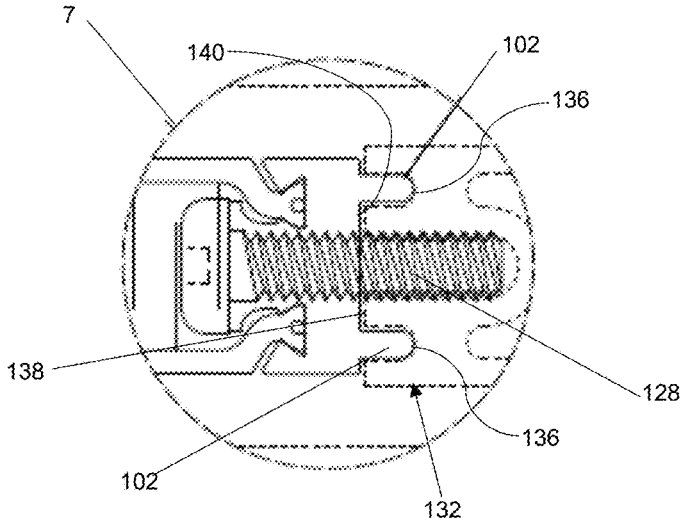
FIG. 7 is an enlarged view of portion 7 on FIG. 6 yet in accordance with another non-restrictive illustrative embodiment of the present disclosure.

In the embodiment of FIG. 7, the free end 134 of the central protrusion body 108 of the inner frame body 32 includes a pair of lateral grooves 136 for receiving respective protrusions 102. The free end 134 includes a flat portion 138 between the grooves 136 for mating with a complementary flat portion 140 of the connecting element 52 between protrusions 102. The mechanical fastener 128 is fastened through the portion 140 and into the portion 138. In addition to this mechanical fastening, the protrusions 102 and the grooves are bonded via a suitable chemical agent.

Turning back to FIG. 6, sealing elements 142 are shown positioned between the inner frame body 32 and the windowpanes 16.

Figure 8:
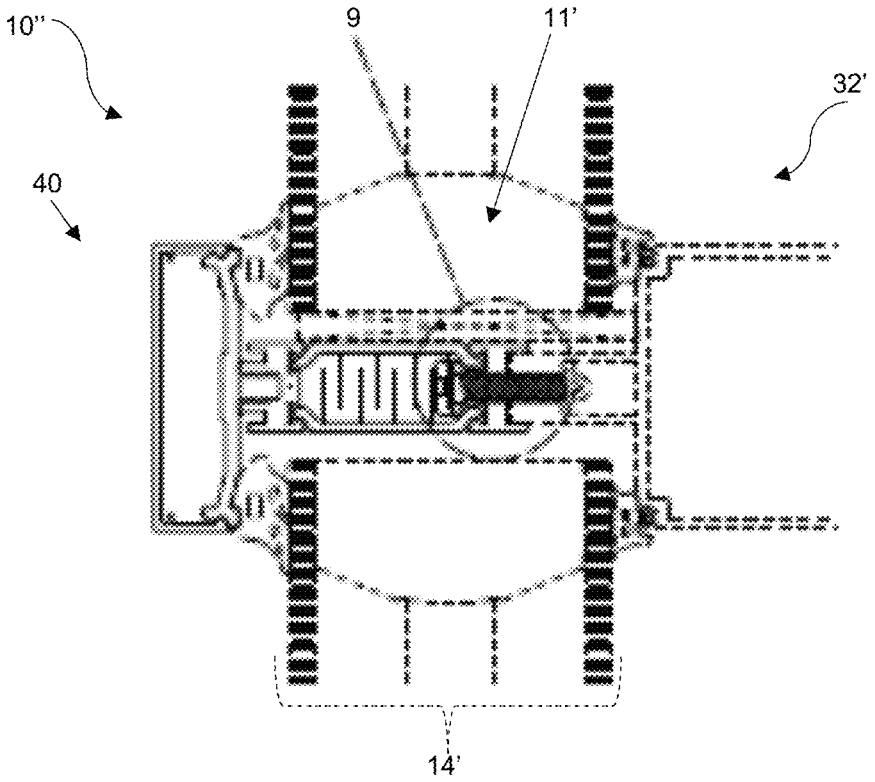
FIG. 8 is a cross-sectional view of a frame system comprising a retrofit adaptor in accordance with another non-restrictive illustrative embodiment of the present disclosure.
Figure 9:
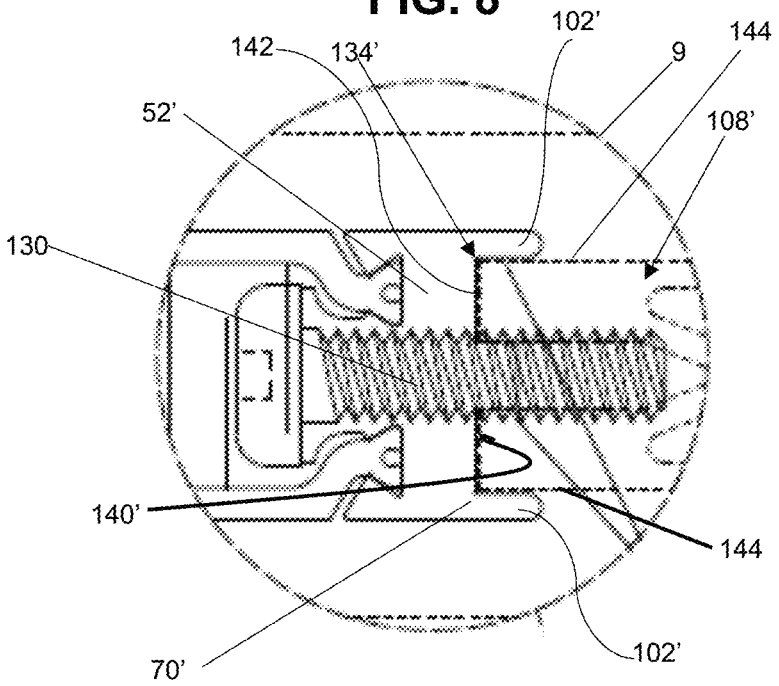
FIG. 9 is an enlarged view of portion 9 of FIG. 8.

With reference to FIGS. 8 and 9, there is shown a retrofitted glazing structure 10" in accordance with another non-restrictive illustrative embodiment of the present disclosure. Unit 10" is similar to unit 10' and such, the present description will focus on the differences therewith for concision purposes only. As shown, unit 10" comprises an inner frame body 32', an outer frame body 40, a retrofitted glazing 14', a retrofit adaptor 11'. Retrofit adaptor 11' includes an outer connecting member 52' having a pair of lateral extensions 102' extending from its connecting end 70' and forming a flat central portion 140' therebetween. The free end 134' of the central extension 108' of the inner frame body 32' defines a flat face 142. The mechanical fastener 130 is fastened through the connecting member 52, passing through the flat central portion 140' and into the flat face 142 for mechanical fastening therewith. The protrusions 102' engage respective lateral sides 144 of the free end 134'.

In an embodiment, the connecting structure along the connecting side 44 of the inner frame body 32 or 32' is provided with an auxiliary element mounted thereto and configured for such connection.

In an embodiment, the adaptor devices, kits, systems and methods herein provide for changing existing storefronts, windows, curtainwalls and the like to more thermally and efficient and effective framing systems allowing for larger glazing structures to increase overall building performance. Thus the adaptor of the disclosure provides the ability to adapt the pre-existing framing system to thicker glazing structures (e.g. glazing units or infill units) of any kind. This is accomplished by increasing the glazing pocket depth and at the same time converting the glazing structure to a thermally broken framing system. The adaptor system also allows more insulation to be installed in non-vision areas (e.g. wall sections, spandrel panels). Due to the increased glazing pocket depth, more insulation is allowed to be added into backpan area (within the thermal break) and in the glazing pocket to cover exposed surfaces of existing interior framing (inner frame bodies) increasing overall thermal performance of framing systems.

The adaptor of the present disclosure has a full thermally broken connection between the interior framing (inner frame body) and the exterior capture system (outer frame body e.g. a pressure plate and cap). The retrofitted system maintains a complete separation of the internal building area and the external area of the building through the insulated portion of the adaptor. The thermal break void or cavity is insulated and maintains this insulation even at fastening points.

In an embodiment, the fastening of the adaptor is provided with chemical bonding agents and mechanical fasteners. The chemical bonding agent provides for bonding and sealing the interior framing (inner frame body) to the inner most base part (inner connecting element) of the adaptor.

In an embodiment, the mechanical fasteners also act as a temporary clamping to keep the adaptor in place while the chemical agent cures. Thus, no other clamping system is required for the foregoing. Indeed, this also allows the exiting glazing structure to remain in place while more efficient glazed windows are sized and purchased. It also keeps the building fully enclosed and weather tight as renovation is done. Only for minimal amount of time to switch old glazed window structures to new glazing window structure does the window opening become exposed to exterior elements.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A retrofit adaptor device for retrofitting a glazing structure comprising an inner frame body and an outer frame body with windowpanes therebetween forming a glazed window, the retrofit adaptor device comprising:

an outer connecting element for being connected to the outer frame body and defining an outer clearance hole therethrough;

an inner connecting element for being connected to the inner frame body; and a thermal break interposed between and connected to the outer and inner connecting elements, the thermal break defining a cavity for receiving insulation therein, the thermal break comprises an elongated hollow body comprising a pair of opposite, spaced apart and separate lateral panels defining the cavity therebetween, each of the panels defining opposite longitudinal ends thereof being respectively mounted to the outer and inner connecting elements, each of the panels comprising an end portion at each of the longitudinal ends thereof, extending from the panel and being inwardly and diagonally directed relative to the cavity;

wherein a mechanical fastener is insertable through the outer clearance hole of the outer connecting element when unconnected to the outer frame body and through the inner connecting element when mounted to the inner frame body, via the cavity, for being fastened to the inner frame body, the outer frame body being connectable to the outer connecting element for closing the outer clearance hole, wherein when the cavity is filled with the insulation the outer clearance hole is plugged thereby.

2. A retrofit adaptor device according to claim 1, wherein the inner connecting element defines an inner clearance hole for the mechanical fastener, wherein when the cavity is filled with the insulation, the inner clearance is plugged thereby.

3. A retrofit adaptor device according to claim 1, wherein the inner connecting element is bondable to the inner frame body via a bonding agent.

4. A retrofit adaptor device according to claim 1, wherein the inner connecting element comprises protrusions for being received by complementary grooves formed within the outer frame body.

5. A retrofit adaptor device according to claim 1, further comprising an auxiliary connecting element mounted to the outer frame body for being mechanically fastened to the outer connecting element.

6. A retrofit adaptor device according to claim 5, wherein the inner connecting element is bondable to the auxiliary connecting element via a bonding agent.

7. A retrofit adaptor for retrofitting a glazing structure comprising an inner frame body and an outer frame body with windowpanes therebetween forming a glazed window, the retrofit adaptor device comprising:

a replacement outer frame body for replacing the outer frame body of the glazing structure;

an outer connecting element for being connected to the replacement outer frame body and defining an outer clearance hole therethrough;

an inner connecting element for being connected to the inner frame body; and a thermal break interposed between and connected to the outer and inner connecting elements, the thermal break defining a cavity for being filled with insulation, the thermal break comprises an elongated hollow body comprising a pair of opposite, spaced apart and separate lateral panels defining the cavity therebetween, each of the panels defining opposite longitudinal ends thereof being respectively mounted to the outer and inner connecting elements, each of the panels comprising an end portion at each of the longitudinal ends thereof, extending from the panel and being inwardly and diagonally directed relative to the cavity;

wherein a mechanical fastener is insertable through the outer clearance hole of the outer connecting element when unconnected to the replacement outer frame body and through the inner connecting element when mounted to the inner frame body, via the cavity, for being fastened to the inner frame body, the replacement outer frame body being connectable to the outer connecting element for closing the outer clearance hole, wherein when the cavity is filled with the insulation the outer clearance hole is plugged thereby.

8. A retrofit adaptor device according to claim 7, wherein the inner connecting element defines an inner clearance hole for the mechanical fastener, wherein when the cavity is filled with the insulation, the inner clearance is plugged thereby.

9. A retrofit adaptor device according to claim 7, wherein the inner connecting element is bondable to the inner frame body via a bonding agent.

10. A retrofit adaptor device according to claim 7, wherein the inner connecting element comprises protrusions for being received by complementary grooves formed within the outer frame body.

11. A retrofit adaptor device according to claim 7, further comprising an auxiliary connecting element mounted to the outer frame body for being mechanically fastened to the outer connecting element.

12. A retrofit adaptor device according to claim 11, wherein the inner connecting element is bondable to the auxiliary connecting element via a bonding agent.

13. A retrofitted glazing structure comprising:

a framing system comprising a pre-existing inner frame body and an outer frame body;

a glazed window mounted to the framing system comprising windowpanes positioned between the inner and outer frame bodies;

a retrofit adaptor mounted to the framing system and comprising:

an outer connecting element connected to the outer frame body and defining an outer clearance hole therethrough, the outer frame body closing the outer clearance hole;

an inner connecting element connected to the inner frame body;

a thermal break interposed between and connected to the outer and inner connecting elements, the thermal break defining a cavity for receiving insulation therein, the thermal break comprises an elongated hollow body comprising a pair of opposite, spaced apart and separate lateral panels defining the cavity therebetween, each of the panels defining opposite longitudinal ends thereof being respectively mounted to the outer and inner connecting elements, each of the panels comprising an end portion at each of the longitudinal ends thereof, extending from the panel and being inwardly and diagonally directed relative to the cavity, the insulation providing for plugging the outer clearance; and a mechanical fastener inserted through the outer clearance hole and through the inner connecting, via the cavity, for fastening the retrofit adaptor device to the inner frame body.

14. A retrofitted glazing structure according to claim 13, wherein the inner connecting element defines an inner clearance hole for the mechanical fastener, the insulation providing for plugging the inner clearance hole.

15. A retrofitted glazing structure according to claim 13, wherein the inner connecting element is bondable to the inner frame body via a bonding agent.

16. A retrofitted glazing structure according to claim 13, wherein the inner connecting element comprises protrusions received by complementary grooves formed within the outer frame body.

17. A retrofitted glazing structure according to claim 13, wherein the retrofit adaptor further comprises an auxiliary connecting element mounted to the outer frame body and mechanically fastened to the outer connecting element.

18. A retrofitted glazing structure according to claim 17, wherein the inner connecting element is bonded to the auxiliary connecting element via a bonding agent.

* * * * *